United States Patent [19]

Meyer et al.

[11] Patent Number: 4,573,856

[45] Date of Patent: Mar. 4, 1986

[54] APPARATUS FOR LOGISTICAL OPERATIONS WITH TEXTILE MACHINERY

[75] Inventors: Wolfgang K. Meyer, Winterthur; Fritz-Werner Breyer, Frauenfeld, both of Switzerland

[73] Assignee: Sulzer Brothers Limited, Winterthur, Switzerland

[21] Appl. No.: 533,962

[22] Filed: Sep. 20, 1983

[30] Foreign Application Priority Data

Sep. 24, 1982 [EP] European Pat. Off. ..... 82810399.4

[51] Int. Cl.[4] ..... D03D 1/00

[52] U.S. Cl. ..... 414/561; 28/208; 139/1 R; 212/129; 212/209; 212/210; 212/213; 212/221; 414/911

[58] Field of Search ..... 212/205, 209, 210, 213, 212/221, 129; 139/1 R; 28/208; 242/58.6; 414/459–461, 911

[56] References Cited

U.S. PATENT DOCUMENTS

| | | | |
|---|---|---|---|
| 1,140,076 | 5/1915 | Shoemaker | 212/210 |
| 3,482,711 | 12/1969 | Böhme et al. | 212/129 |
| 3,784,028 | 1/1974 | Stewart | 212/220 |

*Primary Examiner*—Robert G. Sheridan

*Attorney, Agent, or Firm*—Kenyon & Kenyon

[57] ABSTRACT

An overhead apparatus is provided for conveying elements to and from each weaving machine of rows of weaving machines. The apparatus includes a movable rack which is adjustable width-wise and which carries depending actuators with gripping elements at the lower ends for engaging warp beams and cloth beams. A transverse beam is also provided with depending actuators which carry clamping jaws for engaging the heddles for raising and lowering of the heddles.

Additional actuators may also be provided to carry nozzles for pneumatic cleaning or lubrication of the weaving machines.

13 Claims, 3 Drawing Figures

APPARATUS FOR LOGISTICAL OPERATIONS WITH TEXTILE MACHINERY

This invention relates to an apparatus for logistical operations with textile machinery. More particularly, this invention relates to an apparatus for use with weaving machines for conveying elements to and from each machine.

Heretofore, it has been known to provide various devices for delivering components such as warp beams to a weaving machine. For example, U.S. Pat. No. 2,994,939 decribes a rack which is movably mounted on rollers and which is adapted to receive a number of warp beams. Generally, such a rack can be rolled through an aisle formed between rows of weaving machines to the warp beam side of a given weaving machine in order to mount a warp beam. However, use of a rack of this type is rather limited since only a narrow partial zone of a weaving machine is accessible. Consequently, either the front or back of the weaving machine may be served at any one time. If the rack is to be used at both the front and back of a weaving machine, the rack has to be moved with considerable waste of time through the passages between adjacent weaving machines to the other side of the machine being serviced.

Further, with these racks, access to the center of a weaving machine is inadequate. Also, only a reduced number of control or servicing operations can be performed since the take-up capacity is rather limited. Still further, if a number of various operations are to be performed, time-consuming changeover work must be undertaken on the rack. Finally, in the narrow confines of a weaving room passage, the rack is a hindrance to controlling the weaving machines and to the supply and removal of material to and from the weaving machines.

Accordingly, it is an object of the invention to provide an apparatus of compact construction for logistical operations with a textile machine.

It is another object of the invention to provide for the rapid servicing of all of the weaving machines of a weaving machine row.

It is another object of the invention to provide an apparatus which is readily movable from one weaving machine to another in a weaving room.

It is another object of the invention to provide an apparatus which is capable of performing a number of supply and maintenance operations for a weaving machine without any special changeover work being required.

Briefly, the invention provides an apparatus for logistical operations with textile machinery such as a row of weaving machines wherein the apparatus is mounted in an overhead manner above the weaving machines.

The apparatus includes a rack which is mounted over the textile machines and which includes at least two parallel carrier beams and means for adjusting the carrier beams transversely relative to one another. In addition, at least one element is movably mounted on and longitudinally of each carrier beam and at least one operative device is mounted on each element for infeeding into a textile machine located below the rack.

Each operative device on the rack may be in the form of an adjustable reciprocating actuator which carries a gripper at a lower end for gripping a machine component located below the rack. Consequently, machine components of various lengths, such as warp means, cloth beams, heedles, and the like can be engaged at any time, e.g. at the ends, by a pair of grippers and thereafter raised. In this regard, the spacing of the gripper pair can be adjusted as required to accommodate the length of the machine component.

The rack can, in known manner, be movably supported on a pair of fixed beams, for example suspended from the ceiling of a weaving room and extending over a number of weaving machines, knitting machines or the like. Since the apparatus is disposed at a high point above the floor of the weaving room, accessability of the various machines is not impaired and, for instance, full and empty warp beams can be readily supplied and removed without disturbing the operation of the textile machines. Further, the apparatus can be readily constructed so that every textile machine in the room can be covered.

The rack may also include a further beam which is mounted transversely of the carrier beams for movement longitudinally of the carrier beams. Thus further beam may also have at least two reciprocating actuators movably mounted thereon with each actuator carrying a gripper at a lower end of engaging a respective end, for example of a heddle frame of a weaving machine. In addition, a means is provided for moving the actuators relative to each other longitudinally of this further beam so as to provide for adjustments in the spacing of the grippers relative to each other.

Advantageously, each carrier beam is provided with a guide system having at least two guide planes. This enables the simple linear movement of a number of parallel operative elements to be produced, for example via rolling members such as trolleys moved by rotary devices.

The use of the additional transverse beam permits action to be taken anywhere in the middle of a weaving machine, for example on the heedles or drop wires of a weaving machine.

The operative devices which are mounted for infeeding into the textile machine may be in the form of reciprocating actuators. Further, these reciprocating actuators can be pivoted and/or longitudinally adjustable so as to provide for a range of movements. Further, each actuator may carry a gripper or a nozzle, for example for suction, blowing or for delivering lubricant. This enables virtually every necessary operation to be carried out on a textile machine without having to change over to other operative elements.

The reciprocating actuators may be constructed as telescopic hydraulic or pneumatic cylinders. This imparts further mobility to the operative devices and provides greater access to the textile machine.

In use, different operations can be performed simultaneously by the apparatus. For example, pairs of operative elements can be used for the raising of a warp beam while a pair of actuators of the transverse beam are used for raising of the heedles.

Of note, where the actuators are interconnected via a third reciprocating actuator, the distance between the actuating cylinders can be adjusted independently of the spacing between the beams of a rack.

The grippers which are provided on the reciprocating actuators may be constructed in the form of slide gauges which serve to clamp and/or raise a number of heedles and/or drop wires simultaneously. The heedles can then be raised reliably without the grippers having to be positioned longitudinally very accurately in relation to the heedle length. As a result, expensive optical sensors become unnecessary.

The operative devices can be connected to a common drive and/or control means associated with the rack. In this case, the control means may be connected by way of current collectors to a contact line which extends over at least two textile machines for the transmission of power and/or of control signals. This enables a number of textile machines to be serviced logistically from a central control station, for instance, by a fully automatic program.

These and other objects and advantages of the invention will become more apparent from the following detailed description taken in conjunction with the accompanying drawings wherein.

Figure 1:
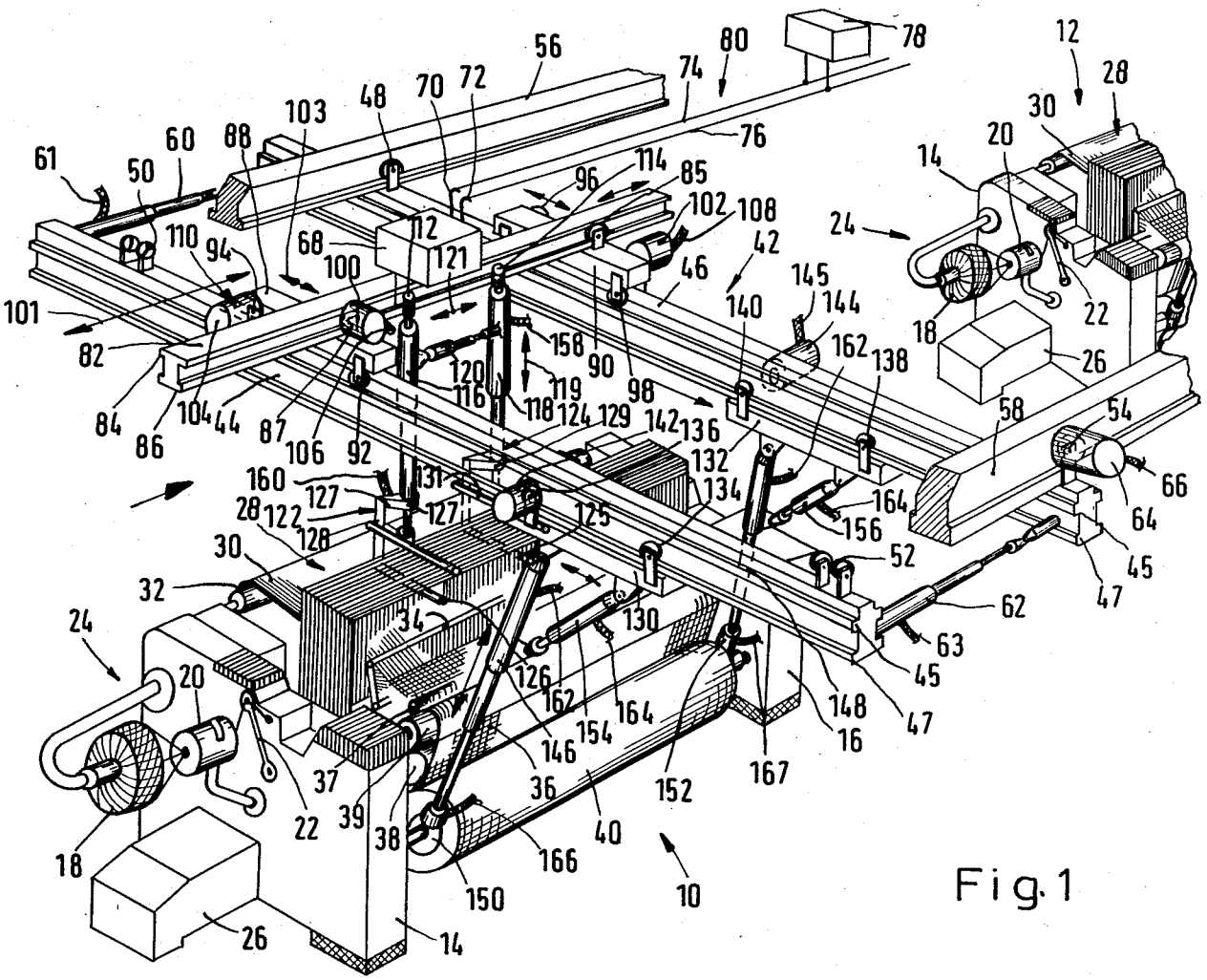
FIG. 1 illustrates a perspective view of an apparatus constructed in accordance with the invention and disposed over a weaving machine.

Referring to FIG. 1, the apparatus for conveying elements to and from a weaving machine is mounted in an overhead manner, for example above a plurality of weaving machines in a weaving room. The apparatus is employed so as to convey elements to and from the individual weaving machines which are arranged in rows within the room. As indicated, the apparatus is disposed to service two weaving machines 10, 12.

Figure 2:
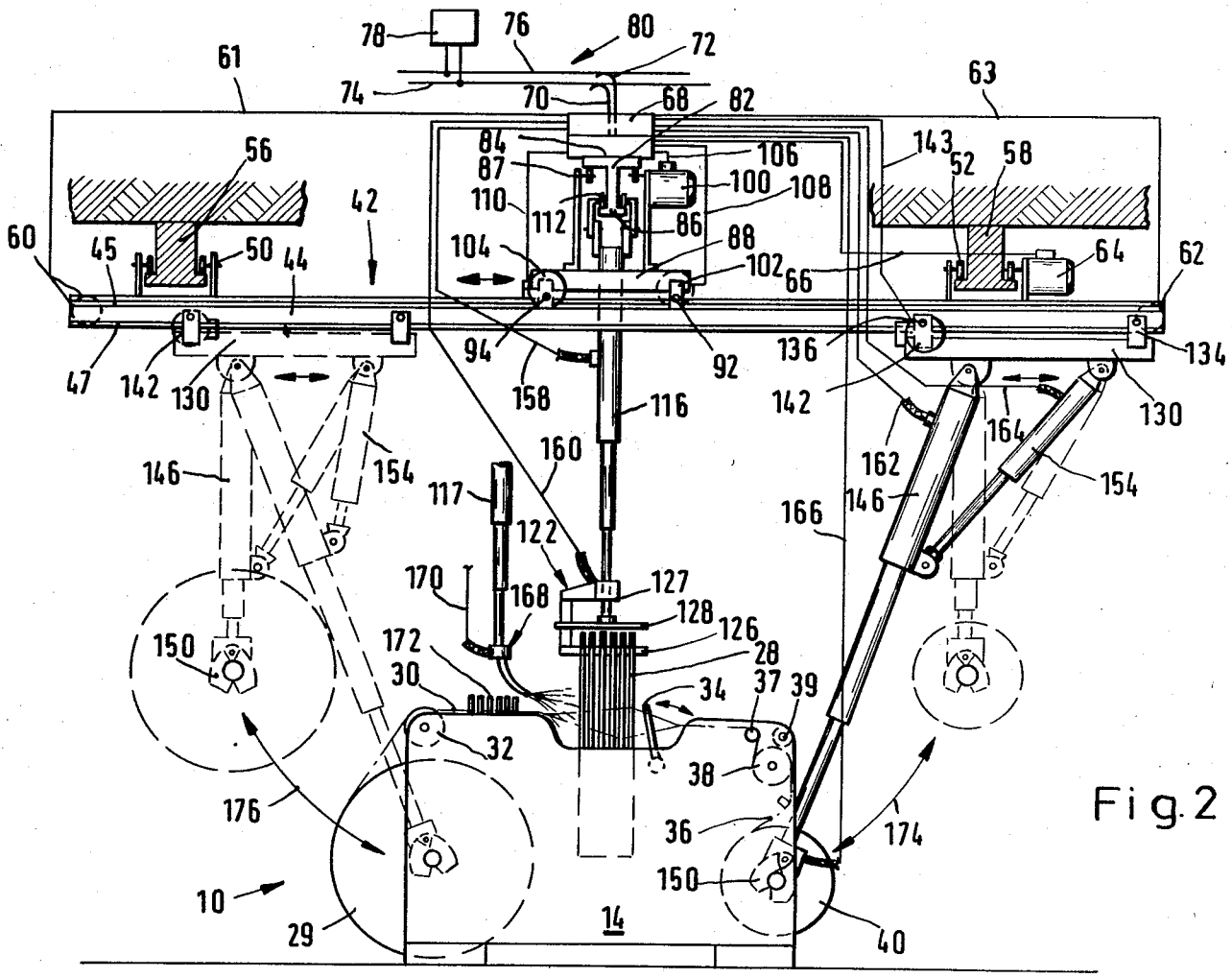
FIG. 2 illustrates a partly diagramatic side view of the apparatus of FIG. 1.

Referring to FIGS. 1 and 2, each weaving machine 10 (12) has a pair of side uprights 14, 16, means for mounting a weft bobbin 18, a picking unit 24 having a yarn store 20 and a yarn tensioner 22, a plurality of heedles 28 and a shedding motion 26 for operating the needles 28. Warp yarns 30 are paid off from a warp beam 29 to pass over a deflecting beam 32 for passage through the heedles 28 and through a reed 34. In known fashion, the resultant cloth 36 passes over a breast beam 37, cloth drawoff roller 38 and a deflecting beam 39 to be wound on a cloth beam 40.

Referring to FIGS. 1 and 2, the apparatus for carrying out various logistical operations with the weaving machines 10, 12 includes a rack 42 which is movably mounted over the weaving machines. The rack 42 has a pair of parallel carrier beams 44, 46 each of which has a double-flange guide system, i.e., in the form of a top flange 45 and a bottom flange 47 to provide two guide planes. Each carrier beam 44, 46 is suspended by way of a pair of roller brackets 48, 54; 50, 52 on two flanged beams 56, 58 which are disposed in the weaving room ceiling lengthwise of the row of weaving machines. In addition, the rack 42 includes means in the form of telescopic reciprocating actuators 60, 62 for adjusting the carrier beams 44, 46 transversely relative to one another.

The rack 42 can be moved along the beams 56, 58 by an electric motor 64 which has a supply line 66 connected to a drive and/or control means 68 (see FIG. 2). The control means 68 is, in turn, connected via two current collectors 70, 72 to two wires 74, 76 of a contact line 80 which is connected to a central sender 78.

The rack 42 also includes a further carrier beam 82 which is mounted transversely of the carrier beams 44, 46 for movement longitudinally of the carrier beams 44, 46. This third carrier beam 32 also has a guide system formed by a top flange 84 and a bottom flange 86 so as to provide at least two guide planes. As shown, the third carrier beam 82 is carried by way of the top flange 84 and a pair of roller brackets 85, 87 on trolleys 88, 89 which, in turn, are carried by way of roller brackets 92, 94; 96, 98 on the top flange 45 of each carrier beam 44, 46. The top flange 45 of these carrier beams 44, 46 thus serve as the guide surfaces for the third beam 82.

A motor 100 is mounted on one trolley 88 in order to move the beam 82 lengthwise as indicated by the arrow 101, i.e., transversely of the carrier beams 44, 46. A motor 102, 104 is also mounted on the respective trolleys 88, 90 in order to move the trolleys 88, 90 and, thus, the beam 82 longitudinally of the beams 44, 46 in the direction indicated by the arrow 103 (FIG. 1). The motors 100, 102, 104 are connected by respective lines 106, 108, 110 to the control means 68.

As shown in FIG. 1, a pair of vertical reciprocating actuators 116, 118 are suspended via roller brackets 112, 114 from the bottom guide flange 86 of the third carrier beam 82. In addition, a horizontal reciprocating actuator 120 connects the two vertical actuators 116, 118 and serves as a means for moving these actuators relative to each other longitudinally of the beam 82. Each of the vertical actuators 116, 118 carriers a gripper 122, 124 at the lower end, as viewed. Each gripper 122, 124 resembles a slide gauge and each has a stationary clamping jaw 126, 125 and a moving clamping jaw 128, 131 which is adapted to be actuated by a respective reciprocating actuator 127, 129. The grippers 122, 124 serve to engage the heedles 28 of the weaving machine 10 for delivery to or lifting from the weaving machine 10.

Each carrier beam 44, 46 also has a trolley 130, 132 suspended from the bottom flange 47 via a respective pair of roller brackets 134, 136; 138, 140. Each of these trolleys 130, 132 is movable via a motor 142, 144 longitudinally of the respective beams 44, 46. The motors 142, 144 are connected via lines 143, 145 to the control means 68. Each trolley 130, 132 also carries a telescopic reciprocating actuator 146, 148 which has a hydraulic or pneumatic gripper 150, 152 at the lower end. In addition, each actuator 146, 148 is articulated to the trolley 130, 132 to pivot via an actuator 154, 156.

As above, each of the actuators 116, 118; 127, 129; 146, 148; 154, 156 as well as the grippers 150, 152 are connected by appropriate lines 158, 160, 162, 164, 166, 167 to the control means 68.

Referring to FIG. 2, the apparatus may also be provided with a further depending reciprocating actuator 117 which carries an operative device 168, for example in the form of a nozzle for suction of blowing or lubrication at the lower end. The means for supplying air or lubricant to the nozzle may also be provided with a line 170 which is connected to the control means 68 for control purposes.

As indicated in FIG. 2, a plurality of drop wire 172, for example of a warp stop motion are provided in the weaving machine in known fashion.

As one example of how the apparatus operates, it is assumed that a full cloth beam 40 is to be removed from a weaving machine 10 while an empty warp beam is to be replaced by a full warp beam.

In response to an appropriate instruction from the sender 78, the motor 64 is actuated to move the rack 42 along the flanged beams 56, 58 to the particular weaving machine 10 to be serviced. The motors 136, 144 are also actuated so as to move the trolleys 130, 132 into an appropriate position before the cloth beam 40. The actuators 60, 62 are also actuated to adapt the grippers 150, 152 on the ends of the depending actuators 146, 148 to the cloth beam length. Thereafter, the actuators 146, 148 and 154, 156 feed the grippers 150, 152 in towards the ends of the cloth beam 40 and actuate the grippers to grip and remove the cloth beam 40 as indicated by the arrow 174 in FIG. 2. The cloth beam 40 can then be removed, for instance, by a separate floor conveyor vehicle or by the overhead apparatus.

In order to change the warp beam 29, the trolleys 130, 132 are then moved to the other side of the weaving machine 10. The actuators 146, 154 are then actuated to move in the direction indicated by the arrow 176 (see FIG. 2). After removal of the empty warp beam 29 from the weaving machine 10, the beam can be placed on a suitable floor conveyor, as above, and removed. Thereafter, a fresh warp beam (not shown) can be mounted in the weaving machine 10 in a similar reverse operation.

During removal of the warp beam 29, the heddles 28 may also be removed. To this end, the transverse carrier beam 82 is moved into position via the motors 100, 102, 104 slightly behind the center of the heddles 28 as seen from the warp side. In addition, the actuator 120 is telescoped in the direction indicated by the arrow 21 (see FIG. 1) in order to place the actuators 116, 118 at an appropriate spaced apart distance from one another. The motors 102, 104 are then operated to introduce the fixed clamping jaws 125, 126 into the heddles 28 in the fashion of a fork lift device. Thereafter, the actuators 127, 129 move the jaws 128, 131 to clamp the heddles 28 between the respective pairs of jaws. The heddles 28 are then raised in the direction indicated by the arrow 119 (see FIG. 1).

Of note, the drop wires 172 can, in known manner, be arranged to be raised at the same time as the heddles 28.

The actuator 117 may also be operated from time to time, for instance, to remove fluff by blowing and/or suction or to provide lubrication.

Figure 3:
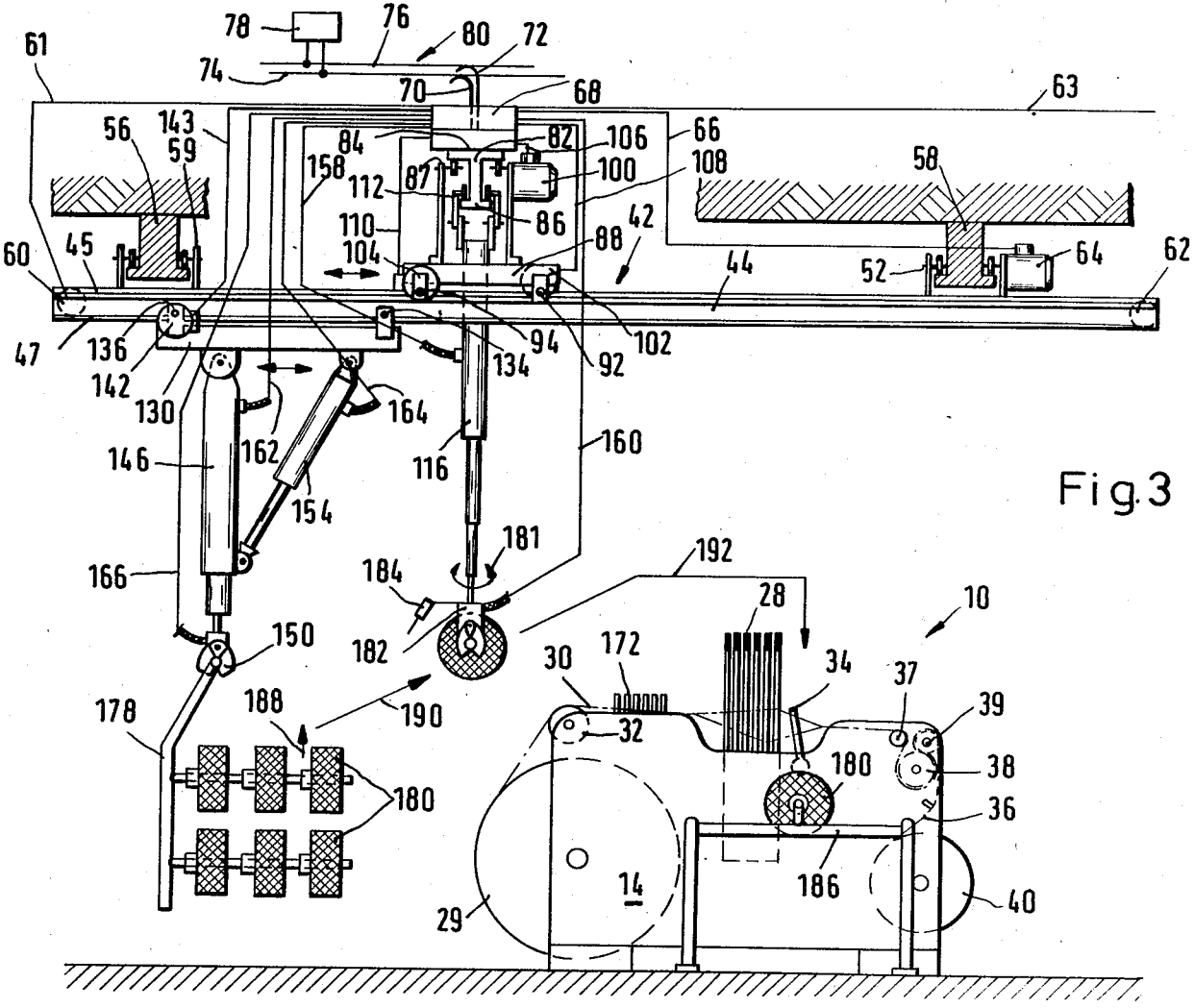
FIG. 3 illustrates a side view of the apparatus of FIG. 1 modified for infeeding a weft bobbin stand and for changing the weft bobbins in a weaving machine.

Referring to FIG. 3, wherein like reference characters indicate like parts as above, the apparatus may also be used for the mounting of weft bobbins 180 in the weaving machines. To this end, the trolleys 130, 132 are moved along the carrier beams 44, 46 to a position above a weft bobbin stand 178 located away from the weaving machine 10. The actuators 146 (148) are then used to lift and carry the bobbon stand 178 to adjacent the weaving machine 10. At this time, the transverse carrier beam 82 is moved so that the actuator 116 is moved toward the bobbin stand 178. In this case, the actuator 116 carries a gripper 182 at the lower end which is rotatable in the direction indicated by the arrow 181 as well as an optical sensor 184. The actuator 116 and gripper 182 are then moved so as to engage one of the weft bobbins 180 from the stand 178 and to move the engaged weft bobbin 180 in the direction indicated by the arrows 188, 190, 192 for introduction into a weft bobbin bracket 186 in the weaving machine 10.

Of note, instead of using motors and trolleys as shown, use may be made of magnetic or pneumatic linear motors.

The invention thus provides an apparatus which can be readily used with textile machines for the logistic operations of conveying elements to and from each machine.

Further, by employing an apparatus which has a plurality of guide planes, different infeed operations may be carried out on a weaving machine at either end.

What is claimed is:

1. An apparatus for logistical operations with textile machinery, said apparatus comprising a rack for mounting over at least one textile machine in movable relation, said rack including at least two parallel carrier beams, means for adjusting said carrier beams transversely relative to one another and a third beam mounted transversely of said adjustable carrier beams for movement longitudinally of said carrier beams;

at least one element movably mounted on and longitudinally of each carrier beam;

at least one operative device mounted on each said element for infeeding into a textile machine located below said rack;

at least two reciprocating actuators movably mounted on said third beam; and second means for moving said actuators relative to each other longitudinally of said third beam.

2. An apparatus as set forth in claim 1 wherein such carrier beam includes a guide system having at least two parallel guide planes.

3. An apparatus as set forth in claim 1 wherein said means includes a pair of reciprocating activators disposed in parallel and connected to and between said carrier beams.

4. An apparatus as set forth in claim 1 wherein said second means is a reciprocating actuator.

5. An apparatus as set forth in claim 4 wherein each of said two reciprocating actuators carries a gripper at a lower end for engaging at least one heedle of a weaving machine.

6. An apparatus as set forth in claim 1 wherein said operative device is an adjustable reciprocating actuator.

7. An apparatus as set forth in claim 1 wherein each actuator carries a gripper at a lower end.

8. An apparatus as set forth in claim 1 wherein at least one actuator carries an air nozzle at a lower end.

9. An apparatus as set forth in claim 1 wherein each actuator is a telescopic cylinder.

10. An apparatus as set forth in claim 1 which further comprises a control means connected in common to each of said means for adjusting said carrier beams, said elements and said operative devices for actuation thereof; a contact line disposed over said rack for transmission of power therethrough; and current collectors connecting said control means to said contact line.

11. In combination with a plurality of weaving machines, an overhead apparatus for conveying elements to and from each machine, said apparatus including a movable rack for mounting over a selected one of said weaving machines, said rack including at least two parallel carrier beams, means for adjusting said carrier beams transversely relative to one another and a third beam mounted transversely of said carrier beams for movement longitudinally of said carrier beams;

at least one trolley movably mounted on and longitudinally of each carrier beam;

at least one reciprocating actuator suspended from each trolley for infeeding into a weaving machine located below said rack and having a gripper at a lower end for gripping a machine element of a weaving machine located below said rack;

two reciprocating actuators movably mounted on said third beam;

means for moving said latter actuators relative to each other longitudinally of said third beam; and a gripper at a lower end of each of said latter actuators for gripping a machine element of a weaving machine located below said rack.

12. The combination as set forth in claim 1 which further comprises a reciprocating actuator suspended from said rack and a nozzle at a lower end of said actuator for positioning astride a machine element of a weaving machine to convey one of air and lubricant therethrough.

13. The combination as set forth in claim 11 which further comprises a pair of fixed beams for supporting said carrier beams of said rack therefrom in suspended relation.

* * * * *

UNITED STATES PATENT AND TRADEMARK OFFICE

CERTIFICATE OF CORRECTION

PATENT NO. : 4,573,856

DATED : March 4, 1986

INVENTOR(S) : WOLGANG K. MEYER, et al

It is certified that error appears in the above-identified patent and that said Letters Patent is hereby corrected as shown below:

Column 1, line 68 change "means" to -beams-
Column 2, line 20 change "Thus" to -This-
  Line 23 change "of" to -for-
Column 4, line 50 change "of" (second occurrence) to -or-
  Line 55 change "wire" to -wires-

Signed and Sealed this

Twenty-fifth Day of August, 1992

*Attest:*

DOUGLAS B. COMER

*Attesting Officer*

*Acting Commissioner of Patents and Trademarks*